US009657962B2

(12) United States Patent
Mosley

(10) Patent No.: US 9,657,962 B2
(45) Date of Patent: May 23, 2017

(54) TOWER FLOOR REGISTER

(71) Applicant: Keith Andre Mosley, Atlanta, GA (US)

(72) Inventor: Keith Andre Mosley, Atlanta, GA (US)

( * ) Notice: Subject to any disclaimer, the term of this patent is extended or adjusted under 35 U.S.C. 154(b) by 400 days.

(21) Appl. No.: 14/191,425

(22) Filed: Feb. 27, 2014

(65) Prior Publication Data

US 2015/0241082 A1 Aug. 27, 2015

(51) Int. Cl.

| | |
|---|---|
| ***F24F 13/08*** | (2006.01) |
| ***F24F 13/06*** | (2006.01) |
| ***F24F 13/02*** | (2006.01) |
| ***F24F 13/00*** | (2006.01) |
| ***F24F 7/04*** | (2006.01) |
| ***F24F 7/06*** | (2006.01) |
| ***F24F 13/04*** | (2006.01) |
| ***F16K 5/02*** | (2006.01) |
| ***F16L 27/12*** | (2006.01) |
| ***F16L 41/02*** | (2006.01) |

(52) U.S. Cl.

CPC ..... *F24F 13/08* (2013.01); *F24F 7/04* (2013.01); *F24F 13/06* (2013.01)

(58) Field of Classification Search

None

See application file for complete search history.

(56) References Cited

U.S. PATENT DOCUMENTS 2,824,575 A * 2/1958 Rosen ..... F16L 37/084 138/109
3,359,883 A * 12/1967 Murphy ..... F24F 13/06 454/306
4,020,753 A * 5/1977 Efstratis ..... F16L 27/12 454/306
4,481,871 A * 11/1984 Efstratis ..... F16L 27/12 403/363
4,735,235 A * 4/1988 Anderson ..... F16L 59/16 138/109
4,850,266 A * 7/1989 Bennett ..... F24F 13/0227 454/284
4,852,470 A * 8/1989 Corriveau ..... F24F 7/06 454/284
4,967,646 A * 11/1990 Brown ..... F24F 13/0227 454/289
5,095,942 A * 3/1992 Murphy ..... F16L 9/003 137/561 A
5,135,436 A * 8/1992 Levy ..... F24F 13/0604 454/306
5,429,113 A * 7/1995 Fowler ..... F24H 9/02 126/114

(Continued)

*Primary Examiner* — Gregory Huson
*Assistant Examiner* — Eric Gorman

(57) ABSTRACT

A free standing tower floor register that replaces the standard in-floor register. The tower floor register's bottom extremity is inserted into the floor opening, does not require screws to bolt it to the floor, and can be relocated to other areas in a room with ease. The stackable tower sections create a vertical duct for channeling airflow upward from the floor and out into a room. The tower can be stacked to the height required to clear the vertical dimensions of obstructing furniture. Rotatable and adjustable directional vent stacks, which can be inserted into the tower directional vent stack manifold, are used to aim the airflow in the direction that provides the desired comfort level.

3 Claims, 4 Drawing Sheets

(56) References Cited

U.S. PATENT DOCUMENTS

| | | | | |
|---|---|---|---|---|
| 5,746,655 | A * | 5/1998 | Lee | F24F 13/12 454/233 |
| 5,915,620 | A * | 6/1999 | Doss | A01K 1/0076 237/46 |
| 6,168,518 | B1 * | 1/2001 | Messmer | F24F 13/06 454/284 |
| 7,022,011 | B1 * | 4/2006 | Rickman | F24F 13/02 454/306 |
| 7,410,416 | B2 * | 8/2008 | Fettkether | F24F 13/0218 454/265 |
| 9,581,379 | B2 * | 2/2017 | Ikeda | F25D 23/00 |
| 2007/0202798 | A1 * | 8/2007 | Billiotte | F24F 3/16 454/264 |

* cited by examiner

TOWER FLOOR REGISTER

The present invention, in general, relates to central heating and cooling systems and, more particularly, to elevate and direct airflow out of a floor register to those areas in a room where it will provide the greatest comfort.

BACKGROUND OF THE INVENTION

Air ducts that radiate out from central plenums and the registers that cover them are well known to the heating and cooling industry. The air ducts are used to route the flow of heated and cooled air to and throughout rooms and areas of homes, apartments, and other types of living spaces.

The current registers include a grille that covers an exposed end of each air duct.

Registers are stationary and usually located on floor, ceiling and wall surfaces. Registers consist of a grille with multiple openings through which air flows. Registers generally includes a series of meagerly angled members that direct the air either right, left, down or up based on whether it is located on the floor, wall, or ceiling. The three sided floor register covers that must be mounted against a wall in order to create a plenum fail to create a tight seal where the unit touches the floor, thus allowing air to escape at the floor level and reducing the velocity of the airflow traveling up the channel. Room occupants located to the left or right of the three sided floor register do not experience the same benefits as do the occupants located in the direct path of the upper and lower vent openings provided. Flexible tubing register covers, consisting of a combination of junction boxes and flexible tubing that run along baseboards in a room, attempt to provide additional airflow outlets along the floor level.

Some registers have dampers which are louvers or a plate that can be moved back and forth to adjust the airflow into a room but cuts off or decreases airflow when moved too far in one direction.

While the above system of air ducts and registers is useful in conveying heated and cooled air into a room, its stationary nature or floor level placement does not take into account where occupants are located in the room and the effect furniture placement has on the flow of air reaching the occupants in the room.

For example, the placement of furniture creates two concerns. If the furniture a person is sitting on is not in the direct path of the airflow they will not experience the greatest benefit due to the limited directional options provided by the stationary system of air ducts and registers. The second concern is that the placement of couches, loveseats, chairs and other room furnishings in close proximity of a register can obstruct the airflow into a room.

There exists today a need for a free standing tower floor register with the means of aiming airflow in multiple directions for the purpose of overcoming the anomalies mentioned above.

Clearly, an apparatus that provides greater flexibility in directing the flow of air into a room regardless of its proximity to furniture and room occupants would enhance the comfort level of room.

DESCRIPTION OF PRIOR ART

Prior art for redirecting air flow includes deflectors that adhere magnetically to a register grille to direct air in a general direction, devices that employ junction boxes and flexible tubing, and devices that employ either mounting screws, adhesive tape, and glue. While the functionality of the known prior types of devices may, at first appearance, have similarities with the present invention, they differ in material respects. These differences, which will be described in more detail hereinafter, underscore the novel functionality that is not available with the prior devices.

OBJECTS AND SUMMARY OF THE INVENTION

It is an object of the present invention to provide a free standing tower floor register that replaces existing types of floor registers.

It is an object of the invention to provide a free standing tower floor register that overcomes the verticality challenges of furniture or objects in a room and can be reconfigured to varying heights.

It is an object of the invention to provide greater flexibility in directing the flow of air into a room.

It is an object of the invention to provide a free standing tower floor register where the base consists of a flange and a plenum chamber section that performs the function of an air supply vent cover when inserted into the floor opening.

It is an object of the invention to provide a free standing tower floor register that contains multiple louvers, housed in adjustable intermediaries, that will be used to adjust the airflow out of the tower and into the room.

It is an object of the invention to provide an aesthetically pleasing free standing tower floor register with multiple interlocking, detachable plenum chamber sections that fit snugly together to create a channel for channeling air upward, and elevates the tower to a height suitable to clear the vertical dimensions of most obstructing furniture near the floor register, or to a level desired by the room occupant.

It is an object of the invention to provide multiple detachable plenum chamber sections whose bottom openings consist of a chamber attachment collar that allows it to receive the top portion of an accompanying plenum chamber section for the purpose of joining the plenum chamber sections snugly together.

It is an object of the invention to provide a vent stack manifold designed to cap off the top opening of the uppermost section of the free standing tower floor register.

It is an object of the invention to provide a vent stack manifold with multiple openings for the purpose of allowing air to flow from the top of the assembled free standing tower floor register. The openings in the tower cap are designed to receive individual directional vent stacks.

It is an object of the invention to provide directional vent stacks that can be rotated circularly 360 degrees and tilted vertically a range of 60 degrees for the purpose of aiming the airflow in multiple directions and at varying angles.

It is an object of the invention to provide directional vent stacks consisting of sliding sections that enables the stacks to be raised or lowered vertically, and enables the opening of the directional vent stack to extend horizontally beyond the edge of the vent stack manifold, and an internal louver panel that can be rotated to adjust the airflow out of the directional vent stack.

DETAILED DESCRIPTION OF THE INVENTION

Figure 1:
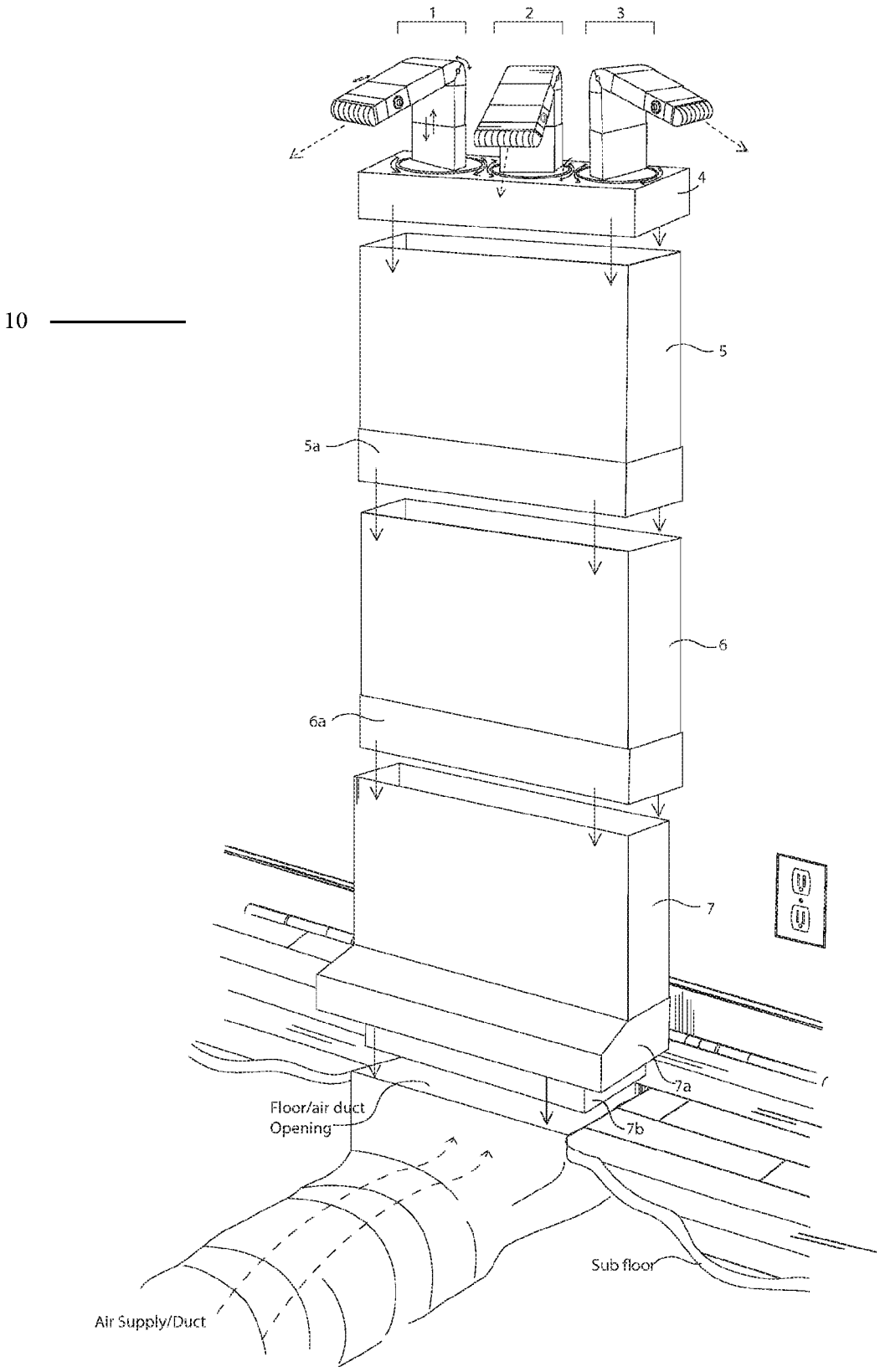
FIG. 1 is an exploded view in perspective of the free standing tower floor register. The air supply/duct and floor cut away are provided for illustration purposes only and are not meant to be claimed as a part of the invention.

Referring to the exploded drawings and particularly to the embodiment shown in FIG. 1 a free standing tower floor register 10 consisting of a stackable plenum comprised of a left directional vent stack 1, a center directional vent stack 2, a right directional vent stack 3, a directional vent stack manifold 4, plenum chamber section 5 with plenum chamber attachment collar 5*a*, plenum chamber section 6 with plenum chamber attachment collar 6*a*, and plenum chamber base 7 with plenum chamber base air duct cover 7*a* and plenum chamber base air duct flange 7*b*.

Figure 2:
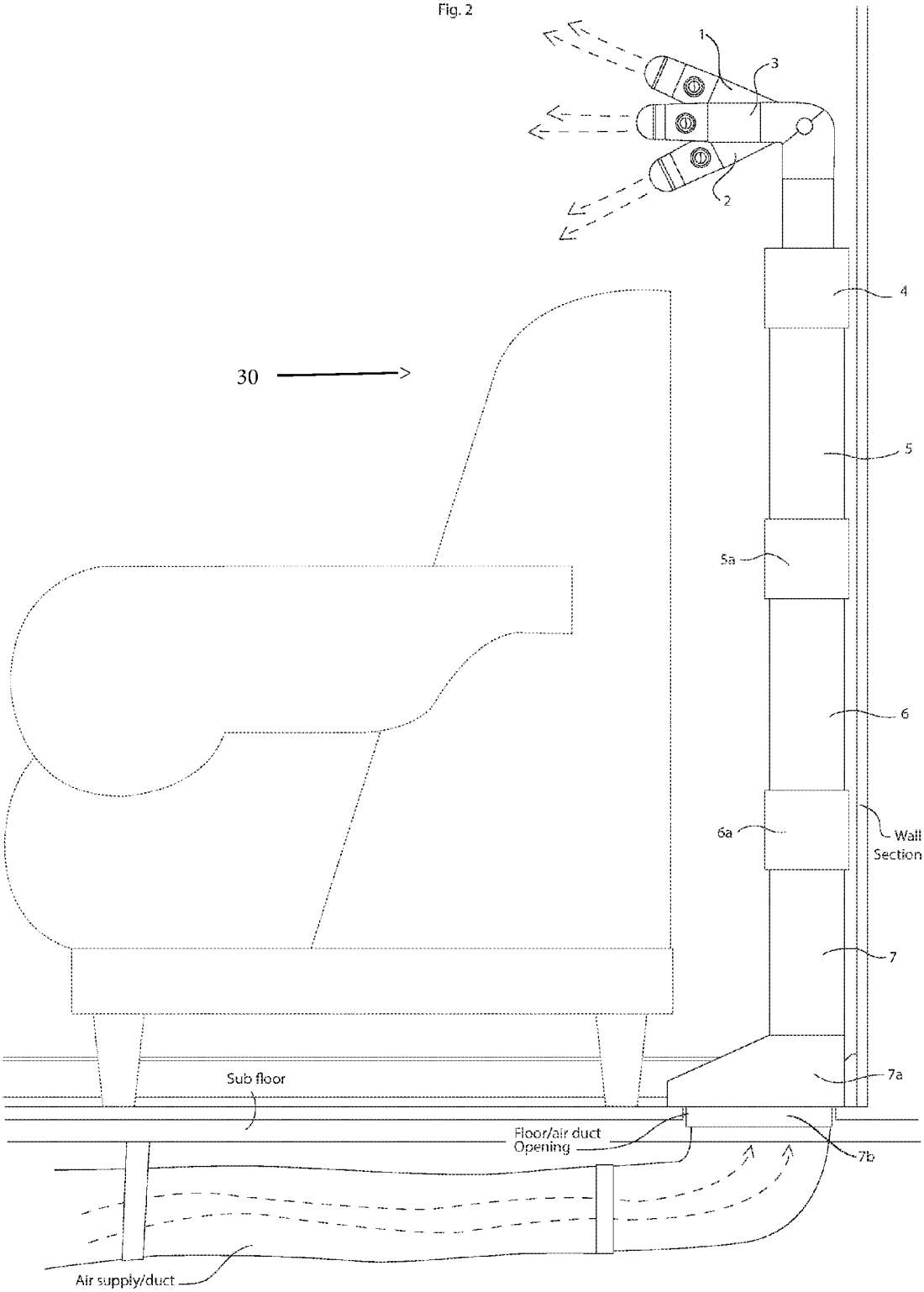
FIG. 2 is a side view in perspective of the fully assembled free standing tower floor register shown in FIG. 1, which has been inserted into the opening in the floor and is not touching the wall. The chair is provided for illustration purposes only and is not a part of the invention.

Referring to the drawings and particularly to the second embodiment shown in FIG. 2 the plenum chamber base air duct flange 7*b* has been placed into the air duct opening in the floor resulting in the plenum chamber base air duct cover 7*a* sealing the opening in the floor. Plenum chamber section 6 is attached to plenum chamber section 7 with the aid of plenum chamber attachment collar 6*a*. Plenum chamber section 5 is attached to plenum chamber section 6 with the aid of plenum chamber attachment collar 5*a*. Directional vent stack manifold 4 is attached to plenum chamber section 5. Right directional vent stack 3 is inserted into directional vent stack manifold 4 and positioned at a 90° angle. Center directional vent stack 2 is inserted into directional vent stack manifold 4 and positioned at a downward 60° angle. Left directional vent stack 1 is inserted into directional vent stack manifold 4 and positioned at an upward 60° angle. Chair 30 is provided for illustration purposes only and is not a part of the invention.

Figure 3:
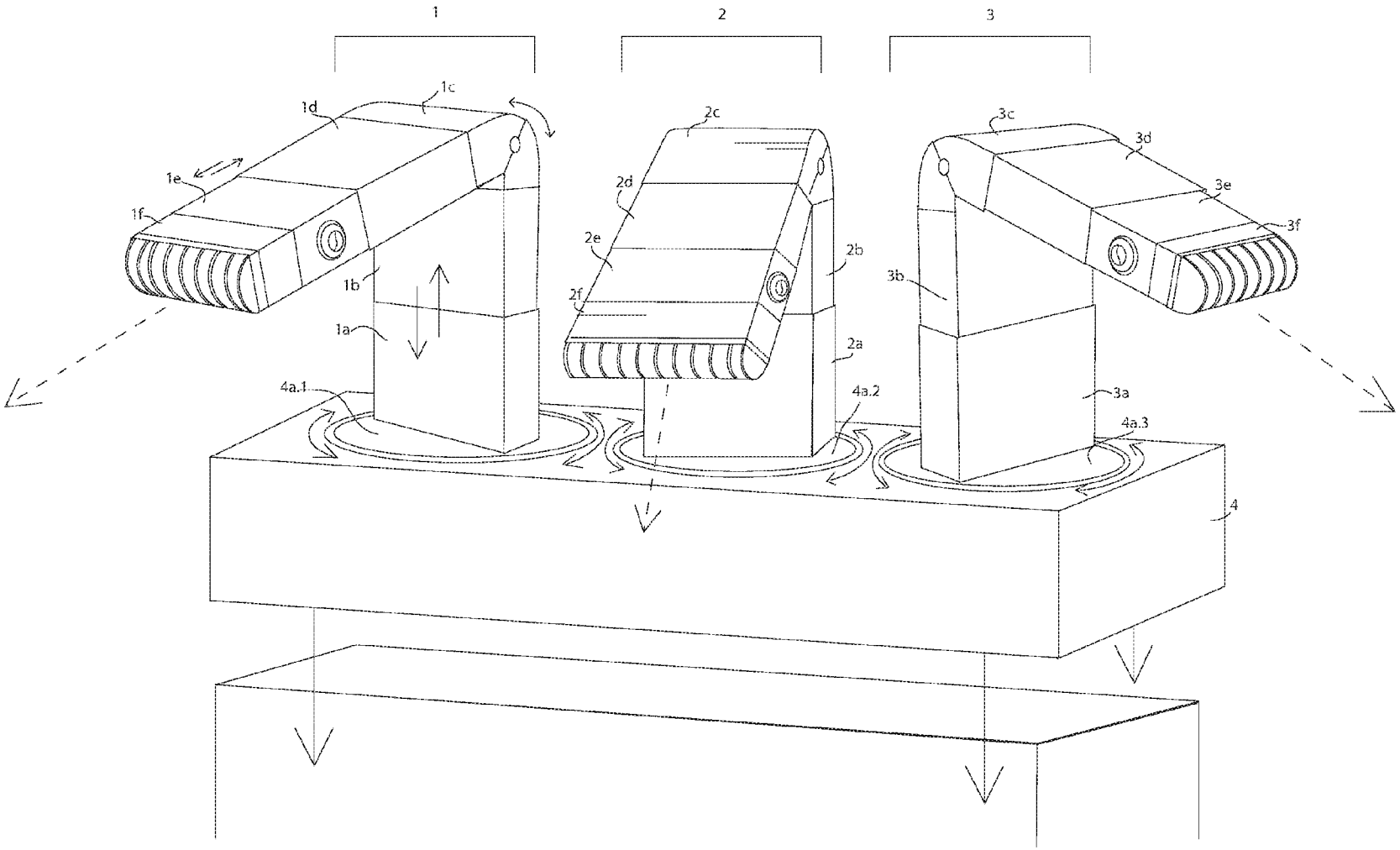
FIG. 3 is a view in perspective of the directional vent stack manifold, which caps off the top of the tower floor register shown in FIG. 1, with the left, center and right directional vent stacks in position.

Referring to the drawings and particularly to the third embodiment shown in FIG. 3 left directional vent stack 1 is comprised of vertical stack base section 1*a*, vertical height adjustment section 1*b*, 60° directional stack adjustment joint 1*c*, horizontal length section 1*d*, horizontal length extender section 1*e*, vent chamber 1*f*. Center directional vent stack 2 is comprised of vertical stack base section 2*a*, vertical height adjustment section 2*b*, 60° directional stack adjustment joint 2*c*, horizontal length section 2*d*, horizontal length extender section 2*e*, vent chamber 2*f*. Left directional vent stack 3 is comprised of vertical stack base section 3*a*, vertical height adjustment section 3*b*, 60° directional stack adjustment joint 3*c*, horizontal length section 3*d*, horizontal length extender section 3*e*, vent chamber 3*f*. Directional vent stack manifold 4 is a plenum chamber attachment collar comprised of vent stack rotatable bases 4*a*.1, 4*a*.2, 4*a*.3, in which vent stacks 1, 2 and 3 are inserted.

Figure 4:
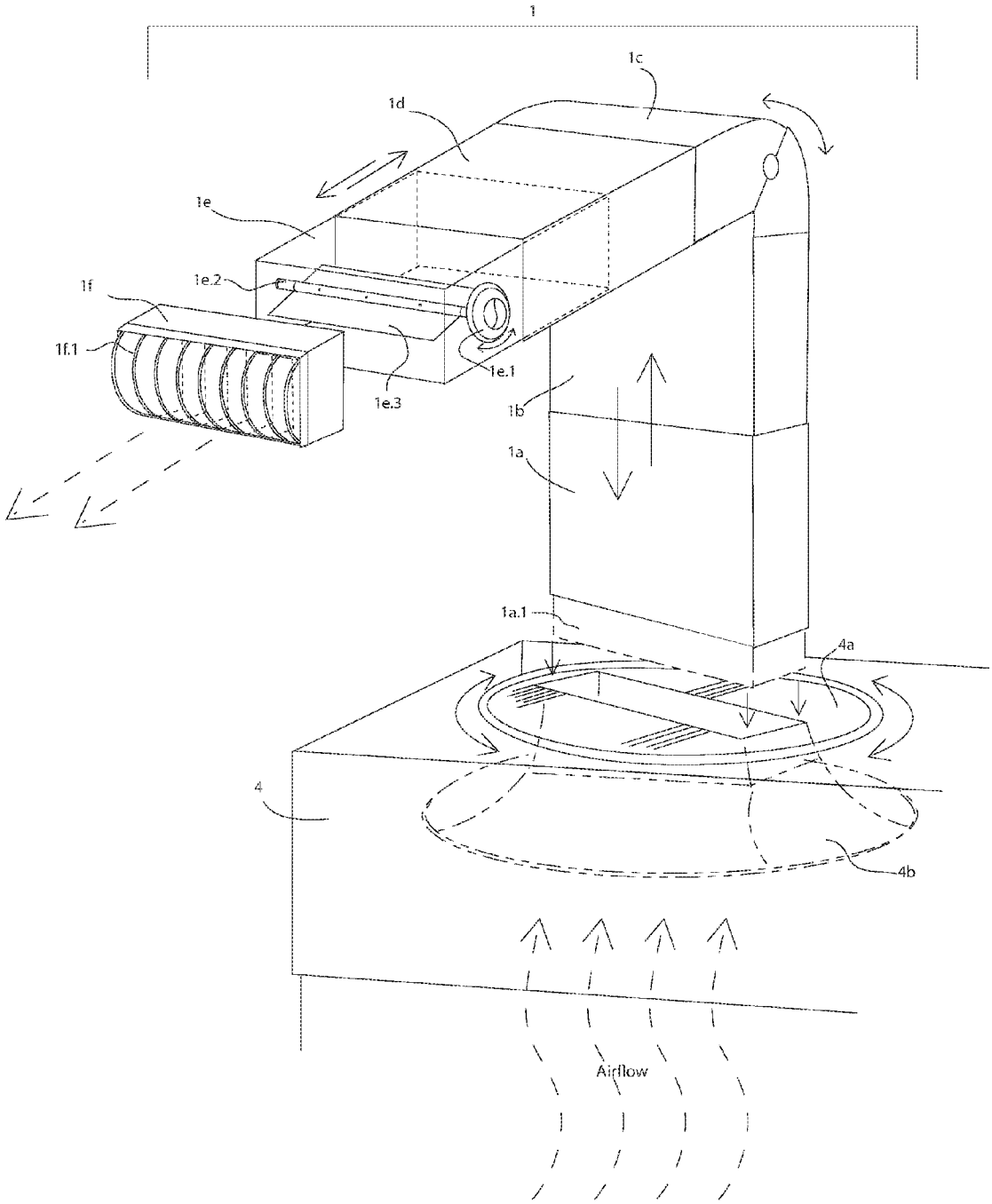
FIG. 4 is a view in perspective of left directional vent stack 1 positioned over an opening in the directional vent stack manifold shown in FIG. 1.

Referring to the drawings and particularly to the third embodiment shown in FIG. 4 left directional vent stack 1 is comprised of vertical stack base section 1*a*, vertical stack base insert sleeve 1*a*.1, vertical height adjustment section 1*b*, 60° directional stack adjustment joint 1*c*, horizontal length section 1*d*, horizontal length extender section 1*e*, airflow volume adjustment knob 1*e*.1, internal louver adjustment bar 1*e*.2, adjustable internal louver panel 1*e*.3, vent chamber 1*f*, and external vent blades 1*f*.1. Directional vent stack manifold 4 is a plenum chamber attachment collar comprised of vent stack rotatable base 4*a*, in which the vertical stack base insert sleeve 1*a*.1 is inserted, and vent stack air intake hood 4*b* is located on the underside of the directional vent stack manifold 4.

What is claimed:

1. A free standing tower floor register that directs airflow in multiple directions for a room, overcomes the verticality challenges of most obstructing furniture in the room, and can be relocated to another location in the room or a house without damaging a wall surface, the free standing tower floor register comprising:

multiple plenum chamber sections, which when joined together will create a channel for directing the airflow upward, said multiple plenum chamber sections can be configured to a height suitable to clear the vertical dimensions of most said obstructing furniture located near a floor or wall register, or configured to a height desired by an occupant of the room;

a base that covers a floor opening and prevents the airflow from escaping when a base flange is inserted into the floor opening, said base contains an initial plenum chamber cover section that serves as a first section of the free standing tower floor register;

a directional vent stack manifold that encloses a top opening of the multiple plenum chamber sections;

wherein said directional vent stack manifold has multiple vent stack rotatable bases that can be rotated circularly 360 degrees;

wherein said multiple vent stack rotatable bases can accommodate individual vent stacks to be inserted and rotated 360 degrees to horizontally discharge the airflow in multiple directions, each said individual vent stack can be tilted vertically from 60 degrees upwards to 60 degrees downwards, raised or lowered vertically, and extended horizontally beyond the edge of the directional vent stack manifold; and wherein the airflow is controlled by a rotatable louver housed in each said individual vent stack.

2. The free standing tower floor register of claim 1, wherein said multiple plenum chamber sections each have a plenum chamber section collar to join the multiple plenum chamber sections together.

3. The free standing tower floor register of claim 1, wherein inserting the base flange into the floor opening creates a tight seal preventing the airflow from escaping the initial plenum chamber cover section and the base.

* * * * *